US009451357B2

(12) United States Patent
Fukuda

(10) Patent No.: US 9,451,357 B2
(45) Date of Patent: Sep. 20, 2016

(54) BONE TRANSMISSION EARPHONE

(71) Applicant: TEMCO JAPAN CO., LTD., Tokyo (JP)

(72) Inventor: Mikio Fukuda, Tokyo (JP)

(73) Assignee: TEMCO JAPAN CO., LTD. (JP)

( * ) Notice: Subject to any disclaimer, the term of this patent is extended or adjusted under 35 U.S.C. 154(b) by 18 days.

(21) Appl. No.: 14/125,096

(22) PCT Filed: Jan. 15, 2013

(86) PCT No.: PCT/JP2013/050547
§ 371 (c)(1),
(2) Date: Dec. 10, 2013

(87) PCT Pub. No.: WO2013/118539
PCT Pub. Date: Aug. 15, 2013

(65) Prior Publication Data

US 2014/0348346 A1 Nov. 27, 2014

(30) Foreign Application Priority Data

Feb. 10, 2012 (JP) ..... 2012-027463

(51) Int. Cl.
*H04R 1/46* (2006.01)
*H04R 1/10* (2006.01)
*H04R 1/02* (2006.01)

(52) U.S. Cl.
CPC ..... *H04R 1/46* (2013.01); *H04R 1/1016* (2013.01); *H04R 1/023* (2013.01); *H04R 2400/00* (2013.01); *H04R 2410/00* (2013.01); *H04R 2460/13* (2013.01)

(58) Field of Classification Search
CPC ..... H04R 2400/00; H04R 1/46
USPC ..... 381/151
See application file for complete search history.

(56) References Cited

U.S. PATENT DOCUMENTS

2011/0135120 A1* 6/2011 Larsen ..... H04R 1/1016 381/151
2013/0121513 A1* 5/2013 Adachi ..... H04R 11/02 381/151

FOREIGN PATENT DOCUMENTS

| | | |
|---|---|---|
| JP | 001682/1995 | 1/1995 |
| JP | 2000-166959 A | 6/2000 |
| WO | 2005/091670 A1 | 9/2005 |
| WO | 2009/072237 A1 | 6/2009 |

OTHER PUBLICATIONS

International Search Report; PCT/JP2013/050547; International File Date: Jan. 15, 2013; Temco Japan Co., Ltd.; 4 pgs.

* cited by examiner

*Primary Examiner* — Duc Nguyen
*Assistant Examiner* — Phan Le
(74) *Attorney, Agent, or Firm* — Schmeiser, Olsen & Watts, LLP

(57) ABSTRACT

A basal end cover having a cable entry portion, and an earphone case which accommodates a bone conduction microphone and a bone conduction speaker, being assembled to the basal end cover, with the earphone case including a rigid resin ear plug having a microphone accommodating space in which the bone conduction microphone to be disposed on the distal end side is accommodated, and a speaker accommodating space in which the bone conduction speaker to be disposed on the basal end side is accommodated, and a sensing cover formed of a material softer than that of the ear plug defining the microphone accommodating space, and a bone-conducted sound is picked up by the bone conduction microphone through the sensing cover is provided.

7 Claims, 3 Drawing Sheets

BONE TRANSMISSION EARPHONE

FIELD OF TECHNOLOGY

The following relates to a bone conduction earphone, and more particularly, a bone conduction earphone which incorporates a bone conduction microphone unit and a bone conduction speaker unit in a single casing.

BACKGROUND

Up to now, attempts to incorporate a microphone unit and a speaker unit in a single casing have been made. Many of them are those which incorporate, in a single casing, a bone conduction microphone unit as a microphone, and an air vibration type speaker, such as a magnetic type one, ceramic type one, or dynamic type one, as a speaker (see FIG. 3). However, with this type of speaker and microphone containing type unit, the sound emitting port is opened, and thus it is difficult to provide a water-proof or dust-proof construction.

The present applicant has already proposed a bone conduction earphone with which a bone conduction microphone and a bone conduction speaker are incorporated in a single casing (Japanese Unexamined Patent Application Publication No. 2000-166959). This bone conduction earphone is composed of an insertion portion which is inserted into the external ear canal, being tightly contacted with the wall thereof, and a bone conduction speaker accommodating portion which is fixed to the insertion portion, the insertion portion being defined to be an earmold made of such a material as a relatively rigid plastic one. And, the bone conduction microphone is disposed being hermetically sealed in the rigid earmold, and the voice of the user is picked up by the bone conduction microphone from the external ear canal wall directly through the rigid earmold as a bone-conducted sound to be amplified and transmitted.

However, with this bone conduction earphone, the voice of the user is picked up by the bone conduction microphone as a bone-conducted sound through the rigid earmold which is inserted into the external ear canal, being tightly contacted with the wall thereof, and therefore, it is undeniable that someone can have an uncomfortable feeling (or a painful feeling). In the aforementioned patent document, it is stated that, in order to provide an improved feeling of wearing, the portion around the distal end of the earmold may be made of a soft material, however, this measure can be taken only for the portion around the distal end of the earmold.

In addition, with this bone conduction earphone, a bone-conducted sound is sensed by the rigid earmold portion, and the bone-conducted sound is transmitted directly from the earmold to the bone conduction microphone, with no consideration being given about the control of the acoustical characteristics (frequency characteristics) in that portion, and no special water-proof measure being taken.

SUMMARY

As described above, with the aforementioned conventional bone conduction earphone, the voice of the user is picked up by the bone conduction microphone as a bone-conducted sound through the rigid earmold which is inserted into the external ear canal, being tightly contacted with the wall thereof, thereby problems having been presented that someone can have an uncomfortable feeling (or a painful feeling), that, with this bone conduction earphone, a bone-conducted sound is sensed by the rigid earmold portion, the bone-conducted sound being transmitted directly from the earmold to the bone conduction microphone, with no consideration being given about the control of the acoustical characteristics (frequency characteristics) in that portion, and further that no special water-proof measure is taken.

A first aspect relates to a bone conduction earphone which gives a good feeling of wearing, can be a unit of a complete waterproof and dustproof construction, and in the bone conduction microphone installation portion, allows the acoustical characteristics (frequency characteristics) to be controlled.

The invention according to claim 1 for solving the above problems is a bone conduction earphone, including:

- a basal end cover having a cable entry portion, and an earphone case accommodating a bone conduction microphone and a bone conduction speaker, and being assembled to the basal end cover,
  - the earphone case including: a rigid resin ear plug having a microphone accommodating space for accommodating the bone conduction microphone to be disposed on the distal end side, and a speaker accommodating space for accommodating the bone conduction speaker to be disposed on the basal end side; and a sensing cover formed of a material softer than that of the ear plug defining the microphone accommodating space,
- a bone-conducted sound being picked up by the bone conduction microphone through the sensing cover.

In one embodiment, the sensing cover has a space portion in the bottom of the distal end portion, the outer wall face of the space portion sensing a bone-conducted sound. The outer wall face forming the space portion is formed so as to be brought into a bulged state.

Further, in one embodiment, the ear plug is provided with a capillary tube extending in a lengthwise direction to communicate between the microphone accommodating space and the space portion for controlling the acoustical characteristics.

Further, in one embodiment, partition plates are provided in the speaker accommodating space on the distal end side and the basal end side thereof so as to be opposed to each other, the bone conduction speaker being provided for either one of the partition plates such that the vibration portion thereof is abutted against the partition plate, or the bone conduction speaker is loaded in the speaker accommodating space, being previously incorporated in a small case.

Still further, in one embodiment, a small substrate to which a cable is wired is disposed in a space inside of the basal end cover, or the space inside of the basal end cover is filled with a waterproof material.

The bone conduction earphone in accordance with the present invention is configured as above, offering advantages that, as a speaker and a microphone, those of bone conduction type are used, and there exists no opening communicating with the outside, whereby the bone conduction earphone can be a unit of a complete waterproof and dustproof construction, and that the earphone structure allows the bone conduction speaker and the bone conduction microphone to be accommodated in the same case, whereby excellent operability and wearability are provided.

In accordance with the invention according to claim 4, a capillary tube is formed in the ear plug so as to extend in a lengthwise direction, whereby there is offered an advantage that, upon the air vibration for transmitting the sound passing through this capillary tube, the viscous friction suppresses the high frequencies, the acoustical characteristics being controlled, and in accordance with the inventions according to claims 6 and 7, there is offered an advantage that the water-proof and dust-proof capability is further assured.

BRIEF DESCRIPTION

DETAILED DESCRIPTION

Figure 1:
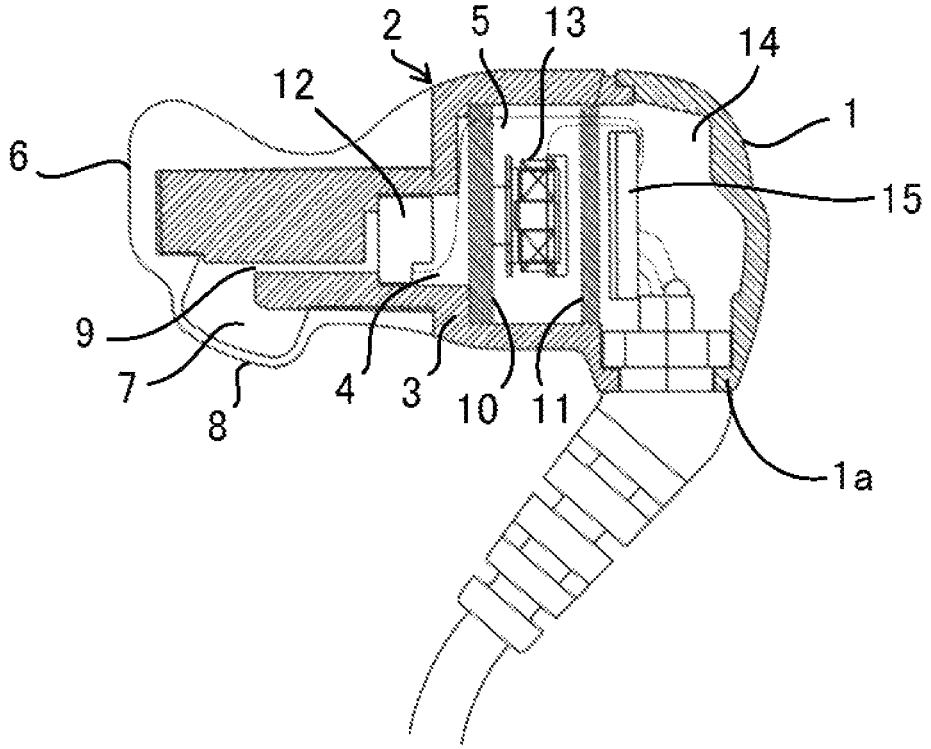
FIG. 1 is a longitudinal sectional view of one embodiment of a bone conduction earphone in accordance with the present invention.

Hereinbelow, an embodiment for carrying out the present invention will be explained with reference to the accompanying drawings. FIG. 1 is a longitudinal sectional view of one embodiment of a bone conduction earphone in accordance with the present invention, and as shown in that figure, the bone conduction earphone in accordance with the present invention includes a basal end cover 1 having a cable entry opening 1*a*, and an earphone case 2 which is assembled to the basal end cover 1, accommodating a bone conduction microphone 12 and a bone conduction speaker 13.

The earphone case 2 includes an ear plug 3 made of a rigid resin having a microphone accommodating space 4 in which the bone conduction microphone 12 to be disposed on the distal end side is accommodated, and a speaker accommodating space 5 in which the bone conduction speaker 13 to be disposed on the basal end side is accommodated, and a sensing cover 6 made of a material softer than that of the ear plug 3 defining the microphone accommodating space 4. In a preferred embodiment, a space portion 7 is formed in the bottom of the distal end portion of the sensing cover 6, and an outer wall face 8 which is of a thin wall, defining the space portion 7, is brought into a bulged state to be tightly contacted with the inner wall of the external ear canal for sensing a bone-conducted sound.

The ear plug 3 is composed of a larger diameter portion in which a speaker accommodating space 5 is formed, and a smaller diameter portion in which a microphone accommodating space 4 is formed, the smaller diameter portion being protruded forward such that it is inserted into the external ear canal, upon the ear plug 3 being worn. And, in this smaller diameter portion, there is formed a capillary tube 9 which extends in a lengthwise direction and communicates between the microphone accommodating space 4 and the space portion 7. The capillary tube 9 functions such that it controls the acoustical characteristics of the bone conduction microphone 12. In other words, while the air vibration for transmitting the sound is passed through this capillary tube 9, the unnecessary high frequencies other than the voice band are dampened by the viscous friction. In this way, the sensitivity in the voice band can be improved, and the insulating effect on the external noise can also be improved.

Figure 2:
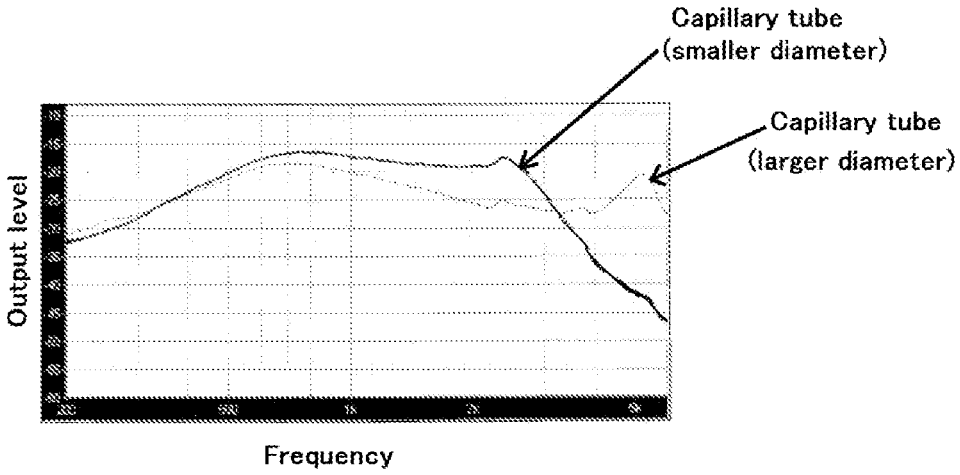
FIG. 2 is a graph depicting a characteristic change in the bone conduction earphone in accordance with the present invention.
Figure 3:
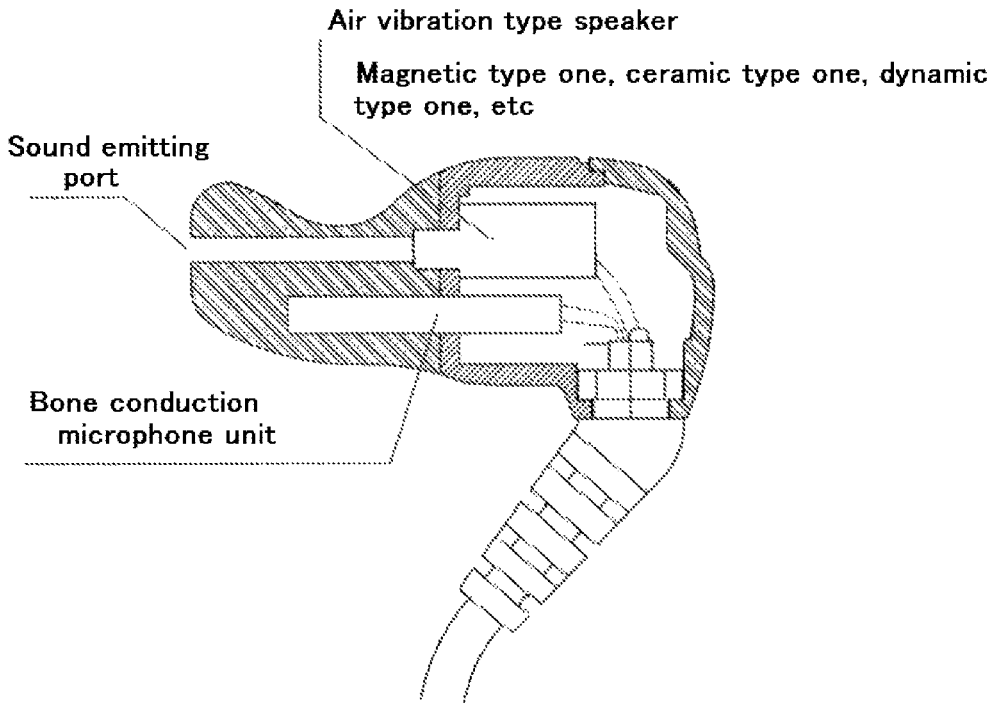
FIG. 3 is a longitudinal sectional view showing an example of configuration of a conventional speaker and microphone containing type unit.

FIG. 2 is a graph showing the characteristic change of the bone conduction microphone 12 in the case where the capillary tube 9 is provided, and it can be seen that the output level is abruptly lowered at a point of approx. 2.5 kHz. In the invention of the present application, it is prescribed that the capillary tube 9 have an inside diameter of 0.3 to 1 mm, and as can be seen from the graph in FIG. 2, if the capillary tube 9 is provided with an inside diameter in this range (in the graph, in the case of the "capillary tube with a smaller diameter", a capillary tube of 0.5 mm in inside diameter having been used as a test sample), the characteristic has been improved, while, if the inside diameter is outside the range (in the graph, in the case of the "capillary tube with a larger diameter"), the characteristic has not been improved.

In the embodiment shown, partition plates 10, 11 are provided in the speaker accommodating space 5 on the distal end side and the basal end side thereof so as to be opposed to each other, and the bone conduction speaker 13 is disposed such that the vibration portion thereof is abutted against the partition plate 10 provided on the distal end side. The bone conduction speaker 13 may be disposed in the same manner against the partition plate 11 on the basal end side. Alternatively, the bone conduction speaker 13 may be previously contained in a small case to be loaded in the speaker accommodating space 5 in that state.

Further, in the embodiment shown, a small substrate 15 (containing an amplifier circuit portion, and the like) to which a cable is wired is disposed in a space portion 14 inside of the basal end cover 1. Further, the space portion 14 in which the small substrate 15 is disposed may be filled with a water-proof material, such as silicone. If such filling is implemented, the seam between the basal end cover 1 and the earphone case 2 is thoroughly sealed from the inside, the water-proof and dust-proof capability is further enhanced.

The bone conduction earphone in accordance with the present invention that is configured as above is used, being inserted into the external ear canal in the same manner as a general hearing aid, an earphone, or the like, and the portion which is inserted into the external ear canal at the time of wearing is mainly the sensing cover 6, which is made of a material softer than that of the ear plug 3. Therefore, the bone conduction earphone in accordance with the present invention can be easily inserted into the external ear canal, can be worn with no uncomfortable feeling, and can be used with a good level of safety. And, at the time of being worn, especially the outer wall face 8 of the sensing cover 6 that is slightly bulged is brought into a tight contact with the inner wall of the external ear canal, whereby the bone-conducted sound (bone vibration) is reliably sensed.

In this way, the voice of the user is picked up by the bone conduction microphone 12 from the external ear canal wall through the sensing cover 6 as a bone-conducted sound to be amplified and transmitted. With this bone conduction earphone, the capillary tube 9 improves the acoustical characteristics of the bone conduction microphone 12 as described above, whereby a speech having a clear sound quality can be sent and received under high noise conditions with one of the ears. When needed, a soundproof type ear plug may be used with an ear on the open side in order to protect the auditory function against the external noise. In addition, instead of an ear plug, an ear muff may be used for covering both entire ears.

The vibration of the bone conduction speaker 13 is transmitted from the partition plate 10 (or partition plate 11), the bone conduction speaker 13 being fixed thereto, to the ear plug 3 and the sensing cover 6, then from the outer face wall 8 to the external ear canal as a bone-conducted sound.

With the bone conduction earphone configured as described above, a bone-conduction type of speaker and that of microphone are used, and there exists no opening communicating to the outside, whereby the bone conduction earphone can be a unit of a complete waterproof and dustproof construction, and the earphone structure allows the bone conduction speaker and the bone conduction microphone to be accommodated in the same case, whereby excellent operability and wearability are provided.

Hereinabove, the present invention has been explained in detail to some extent, and about the most preferred embodiment, however, since it is obvious that a wide range of different embodiments can be made without departing from the spirit and scope of the present invention, it is to be understood that the present invention is not limited to the specific embodiments thereof except as defined in the appended claims.

DESCRIPTION OF SYMBOLS

Reference numeral 1 denotes a basal end cover; 1*a* a cable entry opening; 2 an earphone case; 3 an ear plug; 4 a microphone accommodating space; 5 a speaker accommodating space; 6 a sensing cover; 7 a space portion; 8 an outer face wall; 9 a capillary tube; 10 a partition plate; 11 a partition plate; 12 a bone conduction microphone; 13 a bone conduction speaker; 14 a space portion; and 15 a small substrate.

The invention claimed is:

1. A bone conduction earphone, comprising:

a basal end cover having a cable entry portion; and an earphone case assembled to the basal end cover, the earphone case accommodating a bone conduction microphone and a bone conduction speaker, said earphone case comprising:

a rigid resin ear plug having a microphone accommodating space for accommodating said bone conduction microphone to be disposed on a distal end side, and a speaker accommodating space for accommodating said bone conduction speaker to be disposed on a basal end side; and a sensing cover formed of a material softer than that of said rigid resin ear plug defining said microphone accommodating space, the sensing cover having a space portion proximate a bottom of the distal end portion, said bone conduction microphone picking up a bone-conducted sound through an outer wall face of the space portion;

wherein said rigid resin ear plug is provided with a capillary tube extending in a lengthwise direction to communicate between said microphone accommodating space and said space portion for controlling one or more acoustical characteristics, wherein the bone conduction earphone is waterproof and dustproof, having no opening that communicates with an area outside of the bone conduction earphone.

2. The bone conduction earphone according to claim 1, wherein the outer wall face forming said space portion is formed so as to be brought into a bulged state.

3. The bone conduction earphone according to claim 1, wherein partition plates are provided in said speaker accommodating space on the distal end side and the basal end side thereof so as to be opposed to each other, said bone conduction speaker being provided for either one of said partition plates such that the vibration portion thereof is abutted against the partition plate.

4. The bone conduction earphone according to claim 1, wherein said bone conduction speaker is loaded in said speaker accommodating space, being previously incorporated in a small case.

5. The bone conduction earphone according to claim 1, wherein a small substrate to which a cable is wired is disposed in a space inside of said basal end cover.

6. The bone conduction earphone according to claim 5, wherein the space inside of said basal end cover is filled with a waterproof material.

7. The bone conduction earphone according to claim 1, wherein the bone conduction speaker and the bone conduction microphone is enclosed within the bone conduction earphone.

* * * * *